US011794507B2

(12) United States Patent
Salatandre

(10) Patent No.: US 11,794,507 B2
(45) **Date of Patent: *Oct. 24, 2023**

(54) GREETING CARD WITH GIFT CARD SHIELD AND REVEAL

(71) Applicant: Edgar Davin Salatandre, Toronto (CA)

(72) Inventor: Edgar Davin Salatandre, Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/952,012

(22) Filed: Sep. 23, 2022

(65) Prior Publication Data

US 2023/0013460 A1 Jan. 19, 2023

Related U.S. Application Data

(63) Continuation of application No. 17/010,078, filed on Sep. 2, 2020, now Pat. No. 11,485,163.

(60) Provisional application No. 62/905,520, filed on Sep. 25, 2019.

(51) Int. Cl.
*B42D 15/04* (2006.01)
*G09F 1/04* (2006.01)

(52) U.S. Cl.
CPC ..... *B42D 15/045* (2013.01); *G09F 1/04* (2013.01)

(58) Field of Classification Search
CPC ..... B42D 15/04; B42D 15/045; B42D 73/00; B42D 73/0064; B42D 75/20; G06K 7/00; G09F 1/04
USPC ..... 206/39.7, 232
See application file for complete search history.

(56) References Cited

U.S. PATENT DOCUMENTS 2,917,164 A * 12/1959 Kehr ..... B65D 27/08 206/232
7,163,152 B2 * 1/2007 Osborn ..... A45C 11/182 235/487
8,181,789 B1 * 5/2012 Casella ..... B65D 77/0413 206/39.7
8,800,758 B2 * 8/2014 Roberts ..... B42D 15/045 206/39.7
9,016,469 B2 * 4/2015 Roberts ..... B42D 15/042 40/124.11
10,748,135 B2 * 8/2020 Omojola ..... G06Q 20/3278
2006/0124749 A1 * 6/2006 Osborn ..... A45C 11/182 235/486
2006/0151348 A1 * 7/2006 Willard ..... B65D 73/0078 206/806

* cited by examiner

*Primary Examiner* — Bryon P Gehman
(74) *Attorney, Agent, or Firm* — Head, Johnson, Kachigian & Wilkinson, PC

(57) ABSTRACT

A gift card carrier for use with a greeting card and a greeting card for carrying a gift car is provided. The gift card carrier and the greeting card comprise a base panel comprising a front surface and a back surface, where the front surface has a holding area that is sized and dimensioned to receive the entire gift card therein. They also include a retaining member secured to the front surface for releasably securing the gift card in the holding area, and a metal shield secured to the front surface or the back surface of the base panel, where the metal shield sized to cover, and positioned to correspond with, the holding area.

8 Claims, 8 Drawing Sheets

GREETING CARD WITH GIFT CARD SHIELD AND REVEAL

CROSS-REFERENCE TO RELATED APPLICATION

This application is a continuation application of U.S. patent application Ser. No. 17/010,078 filed Sep. 2, 2020 which claims priority to U.S. Provisional Patent Application Ser. No. 62/905,520, filed Sep. 25, 2019.

BACKGROUND OF THE INVENTION

1. Field of the Invention

The present invention relates generally to gift cards or prepaid cards and their carriers. More particularly, the present invention relates to gift card carriers for use with, or incorporated into, greeting cards.

2. Prior Art

A gift card is commonly purchased for use by an individual and is usable up to its face amount in lieu of cash for goods or services supplied by an affiliated vendor. When gift cards or prepaid cards are given as gifts, they are often accompanied by a greeting card. Standard greeting cards, however, are generally larger than gift cards or prepaid cards. Thus, when combined with the greeting card, there are often shortcomings relating to one or more of packaging, presentation, security, and ease of use.

SUMMARY OF THE INVENTION

Forming one aspect of the present invention is a gift card carrier for use with a greeting card, the gift card carrier comprising:

- a base panel comprising a front surface and a back surface, the front surface having a holding area that is sized and dimensioned to receive the entire gift card therein;
- a retaining member secured to the front surface for releasably securing the gift card in the holding area; and
- a metal shield secured to the front surface or the back surface of the base panel, the metal shield sized to cover, and positioned to correspond with, the holding area.

Another aspect of the present invention is a gift card carrier for use with a greeting card, gift card carrier comprising:

- a base panel comprising a front surface and a back surface, the front surface having a holding area that is sized and dimensioned to receive the entire gift card therein;
- a cover panel secured to the base panel, the cover panel and the base panel collectively forming a double panel with a slot therebetween, the slot being positioned to cover the holding area and dimensioned to receive and hold the entire gift card therein.
- a metal shield secured to the cover panel, the metal shield sized to cover, and positioned to correspond with, the holding area.

A further aspect of the present invention is a greeting card for carrying a gift card, the greeting card comprising:

- a base panel comprising a front surface and a back surface, the front surface having a holding area that is sized and dimensioned to receive the entire gift card therein;
- a retaining member secured to the front surface for releasably securing the gift card in the holding area; and
- a metal shield secured to the front surface or the back surface of the base panel, the metal shield sized to cover, and positioned to correspond with, the holding area.

BRIEF DESCRIPTION OF THE DRAWINGS

The present invention will now be described by way of example only with reference to the following drawings in which.

DETAILED DESCRIPTION OF THE PREFERRED EMBODIMENTS

Referring to FIGS. 1-11, there is shown an example of a gift card carrier 10 in a folded configuration. Gift card carrier 10 includes a base panel 12, a retaining member 14, and a metal shield 16.

Figure 1:
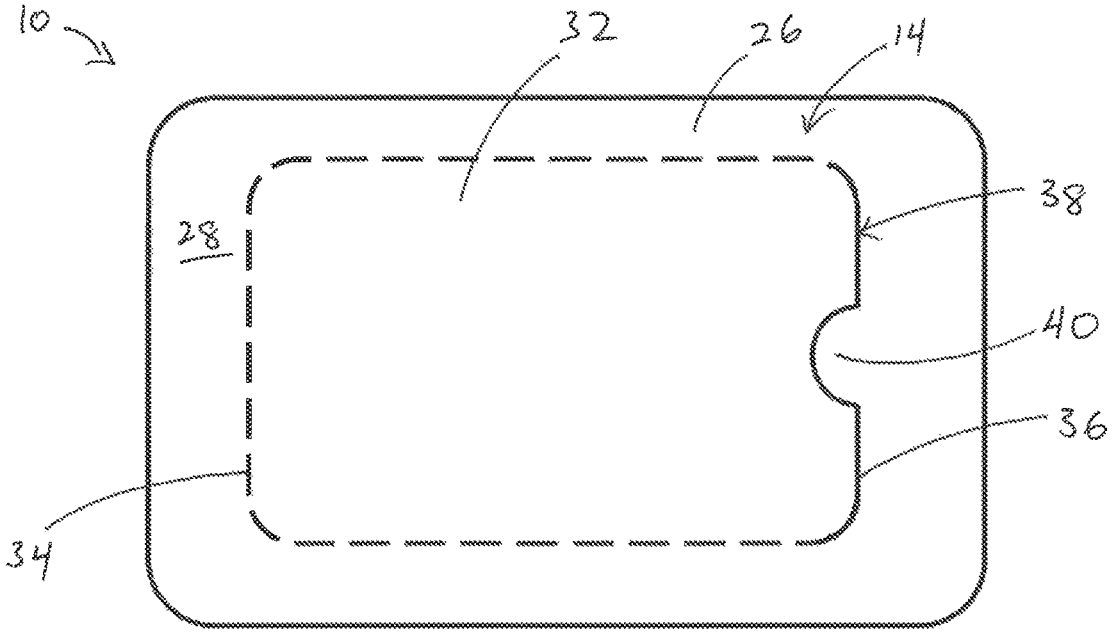
FIG. 1 is a front view of a gift card carrier with a removable pane in a folded configuration according to an example embodiment of the present invention in isolation.
Figure 2:
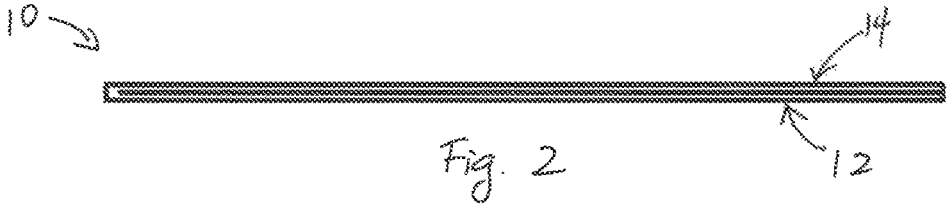
FIG. 2 is a bottom view of the gift card carrier of FIG. 1.
Figure 3:
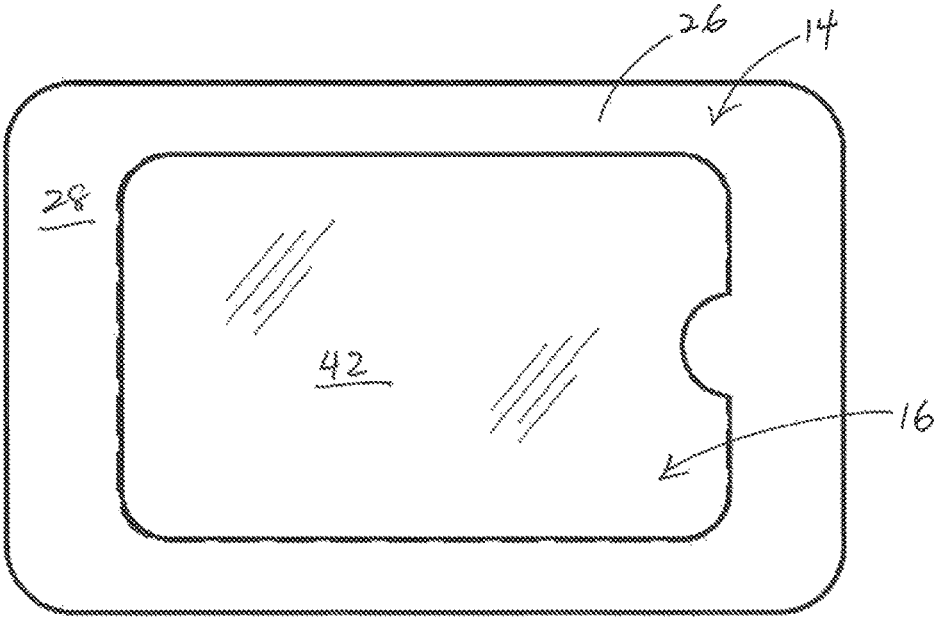
FIG. 3 is a front view of the gift card carrier of FIG. 1 with the pane removed.
Figure 4:
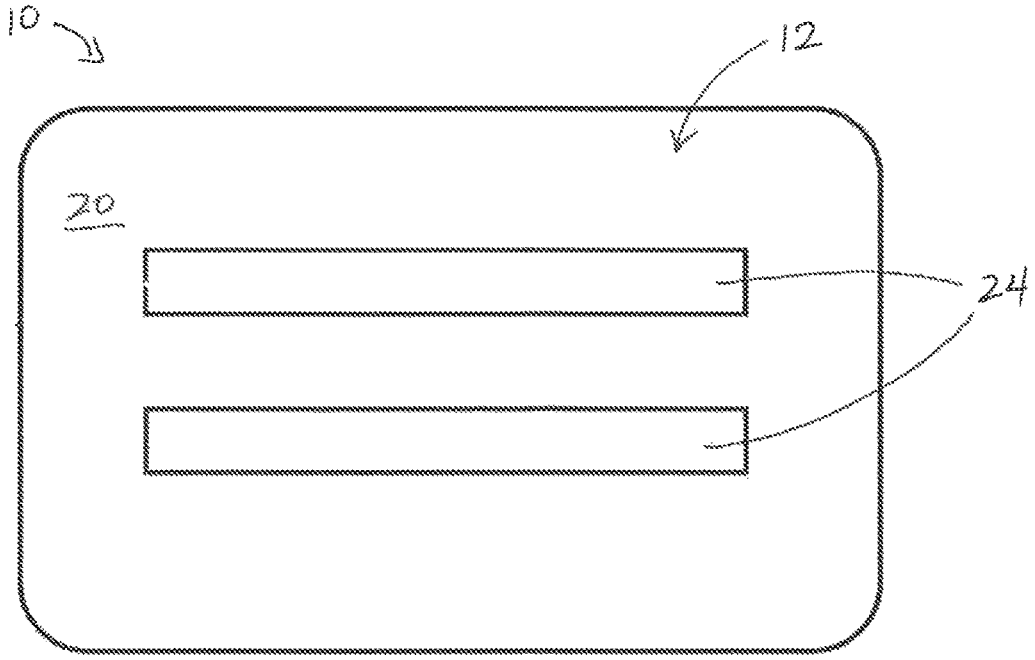
FIG. 4 is a back view of the gift card carrier of FIG. 1.

Base panel 12 includes a front surface 18 and a back surface 20. Front surface 18 has a holding area 22 that is sized and dimensioned to receive an entire gift card therein. Base panel further includes a retention mechanism fixed to back surface 20 of base panel 12. The retention mechanism is adapted to secure gift card carrier 10 to a standard greeting card 100, see FIG. 5 for example. As depicted in FIG. 4, the retention mechanism shown are two strips of double sided adhesive 24.

Retaining member 14 is secured to front surface 18 for releasably securing the gift card in holding area 22. In this particular embodiment, retaining member 14 is a cover panel 26 that is secured about its edges to base panel 12. Cover panel 26 and base panel 12, thus, collectively form a double panel with a slot therebetween. The slot is positioned to cover holding area 22 and the slot is dimensioned to receive and hold the entire gift card therein.

Cover panel 26 further includes a front face 28, a back face 30, and a removable pane 32, where pane 32 is dimensioned and sized to correspond with the slot. As depicted, pane 32 is generally rectangular with rounded corners to correspond with the standard size and shape of gift cards and prepaid cards. Pane 32 is frangibly attached to the rest of cover panel 26 with a perforated boundary 34 along three of its edges. A fourth edge 36 is not attached to the rest of cover panel 26 and helps to define an opening 38 that provides access to the slot. Fourth edge 36 further includes a tab 40.

Metal shield 16 is made of metal. As depicted, metal shield comprises two layers of aluminum 42. One layer is secured to front surface 18 of base panel 12, and the other layer is secured to back face 30 of cover panel 26. Metal shield 16 is at least sized to cover, and positioned to correspond with, holding area 22. In that manner, metal shield 16 covers holding area 22.

Figure 10:
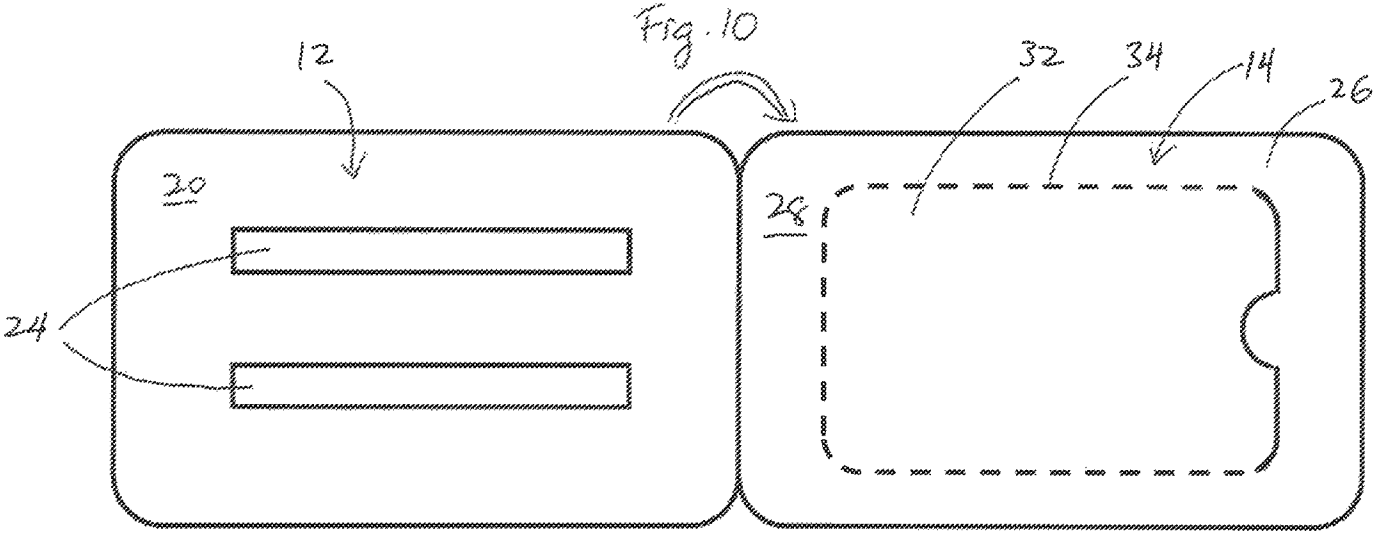
FIG. 10 is a front view of the gift card carrier of FIG. 1 in an unfolded configuration.
Figure 11:
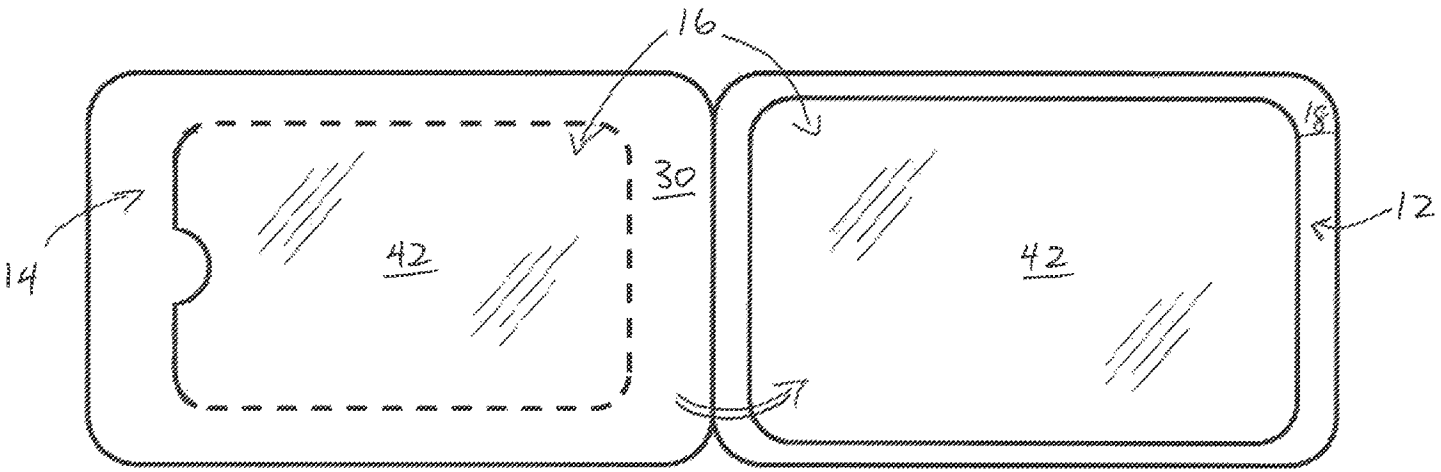
FIG. 11 is a back view of the gift card carrier of FIG. 10.
Figure 12:
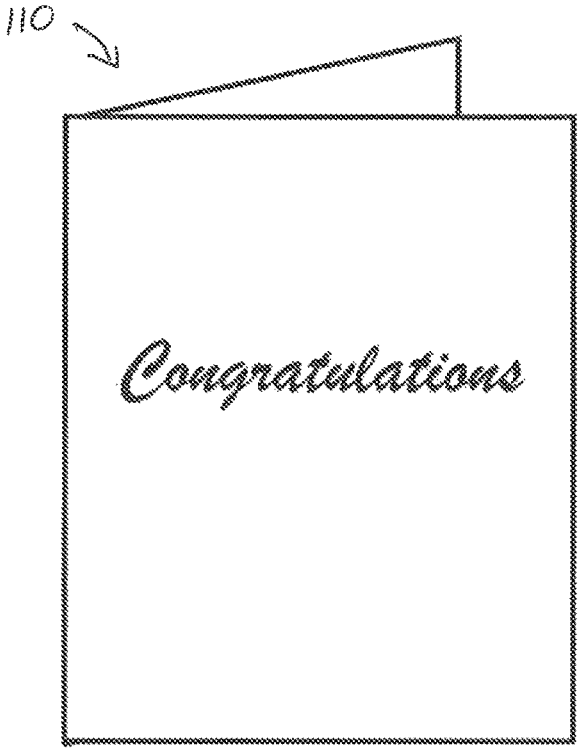
FIG. 12 is a perspective view of a greeting card with a gift card carrier incorporated therein in a folded configuration according to another example embodiment of the present invention.
Figure 13:
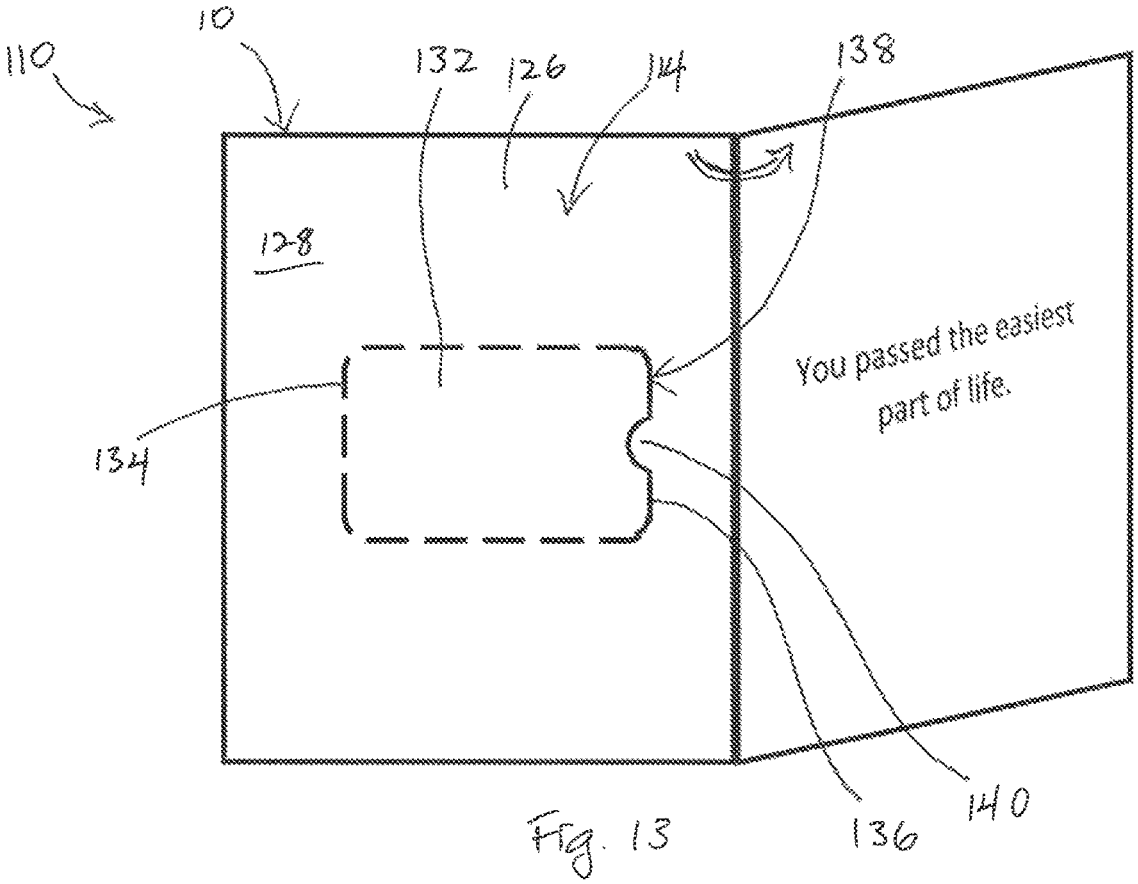
FIG. 13 is an internal view of the greeting card with the gift card carrier of FIG. 12.

FIGS. 1-4 show gift card carrier 10 in a folded configuration. FIGS. 10-11 show gift card carrier 10 in an unfolded configuration. In that manner, base panel 12 and cover panel 26 are integrally connected and formed from a single sheet of material. Folding cover panel 26 over base panel 12 as indicated by the double arrows forms the double panel shown in FIGS. 1-4.

Figure 5:
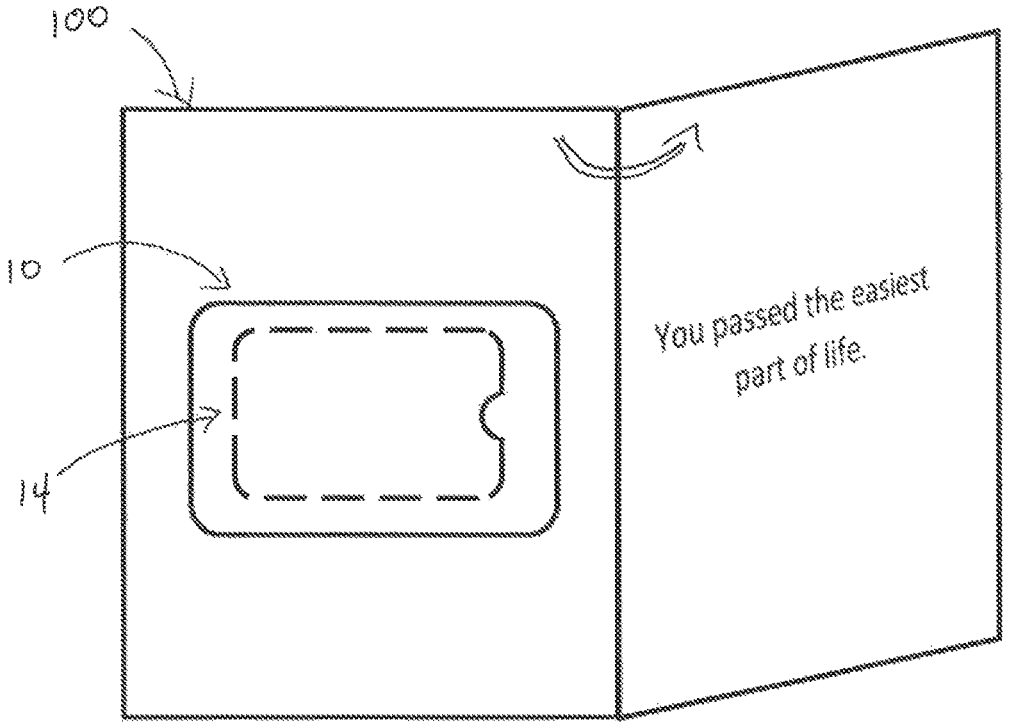
FIG. 5 is front view of the gift card carrier of FIG. 1 secured to a greeting card.
Figure 6:
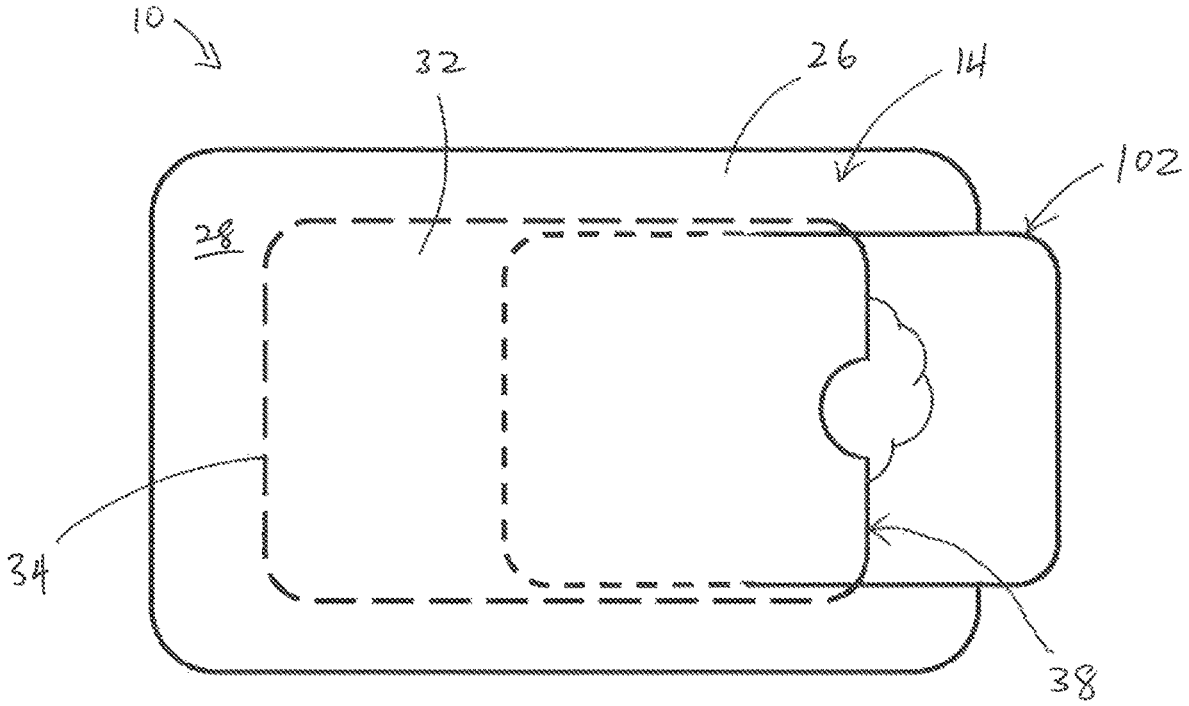
FIG. 6 is a front view of the gift card carrier of FIG. 1 with a gift card partially inserted therein.

In use, gift card carrier 10 may be coupled to greeting card 100 as shown in FIG. 5, before or after a gift card 102 is inserted therein. Referring to FIGS. 6-9, gift card 102 may be inserted into the slot in gift card carrier 10. Tab 40 may be gripped by a user to assist him or her in separating pane 32 from base panel 12 for access to opening 38. In that manner, gift card 102 may be inserted through opening 38 in the slot between base panel 12 and cover panel 26 as shown in FIG. 6.

Figure 7:
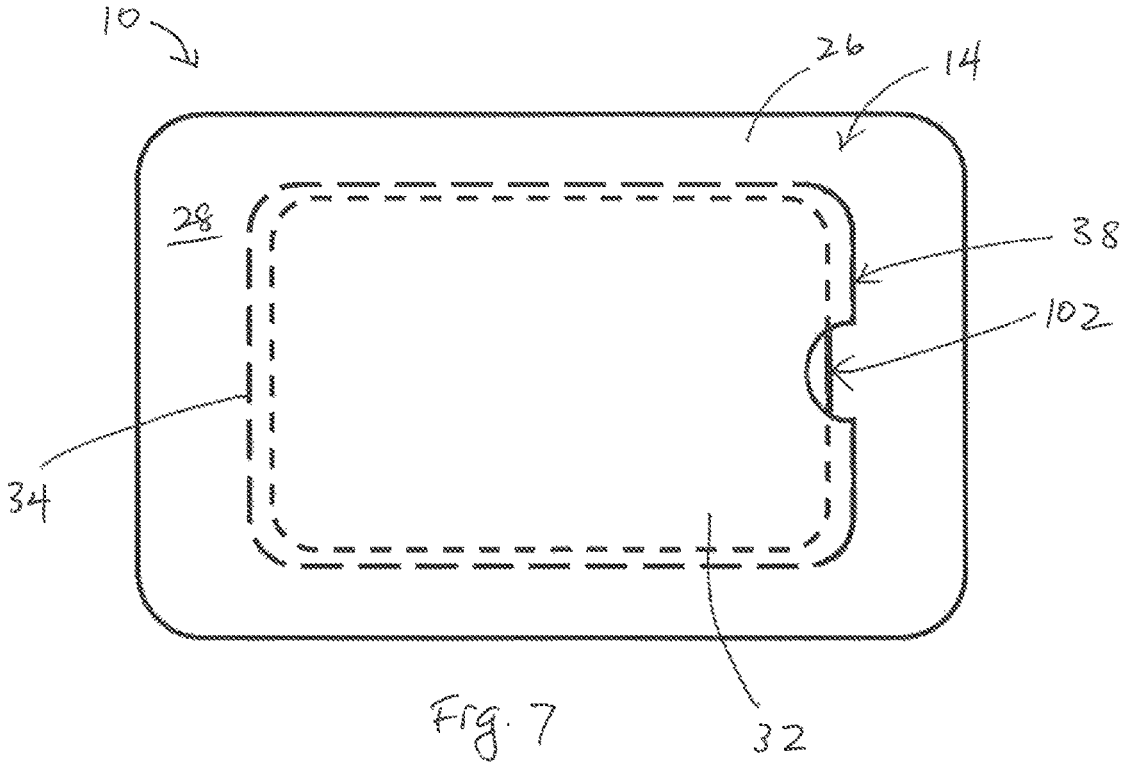
FIG. 7 is a front view of the gift card carrier of FIG. 6 with the gift card fully inserted therein.

Due to the fact that holding area 22 and the slot are shaped and dimensioned to hold the entire gift card 102 therein, gift card 102 may be fully inserted into holding area 22 and the slot through opening 38 as shown in FIG. 7 with a close fit.

Figure 8:
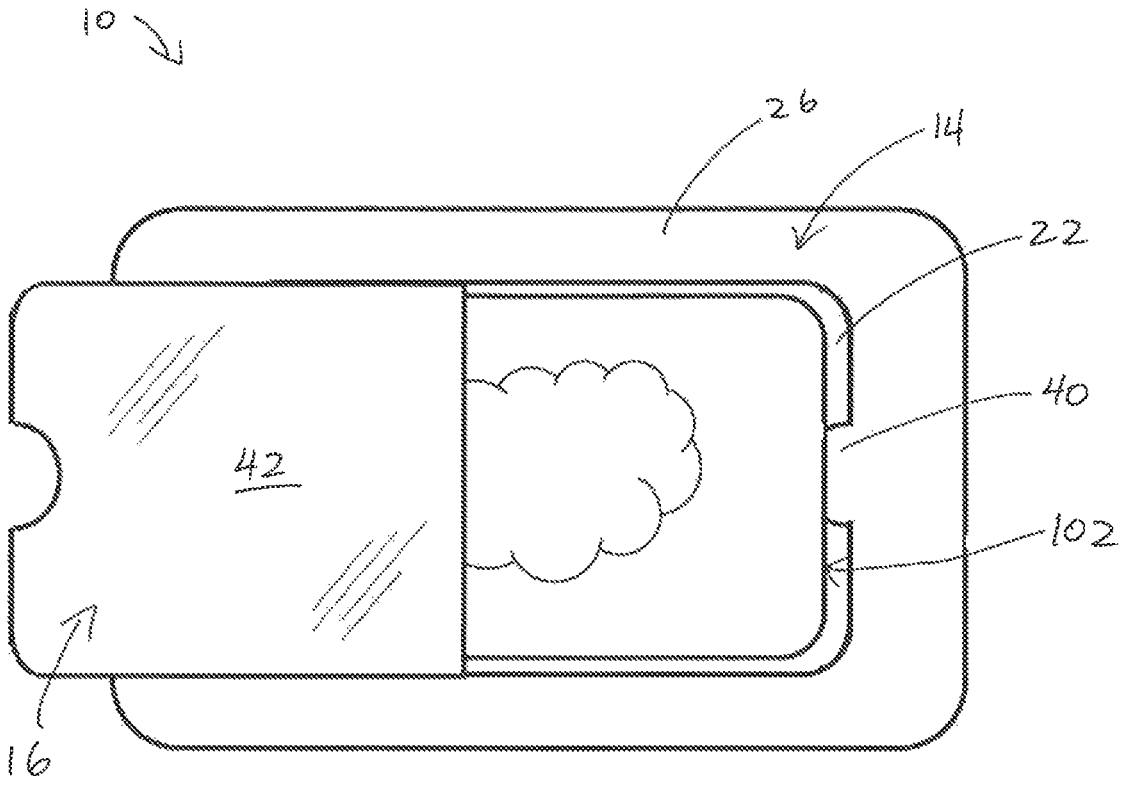
FIG. 8 is a front view of the gift card carrier of FIG. 6 with the removable pane partially removed.
Figure 9:
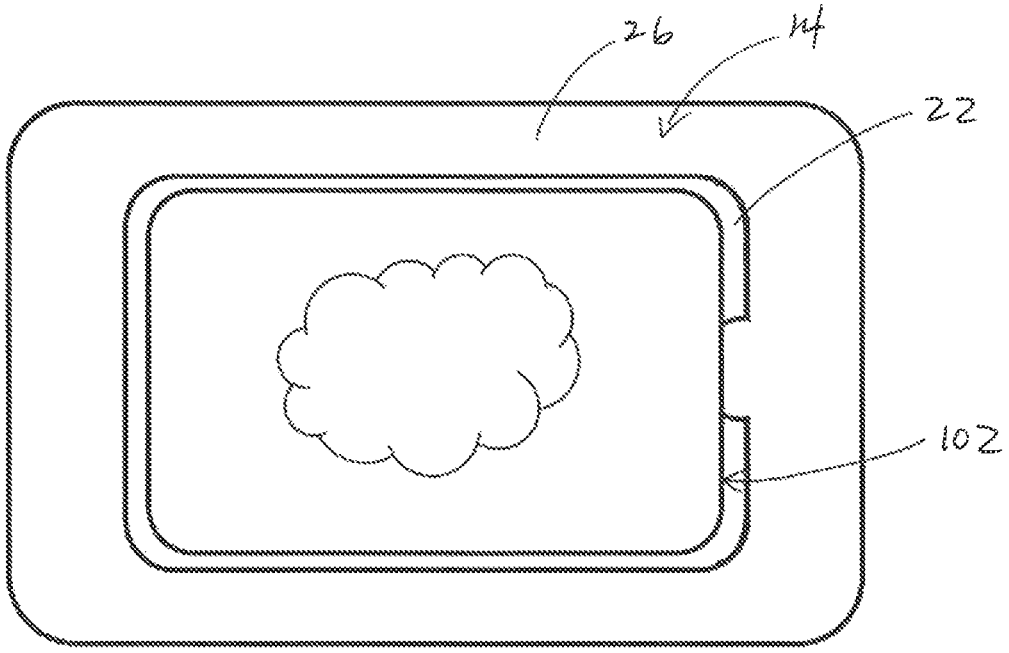
FIG. 9 is a front view of the gift card carrier of FIG. 6 with the removable pane fully removed.

To subsequently access gift card 102, a user may grip fourth edge 36, such as at tab 40, and tear pane 32 along perforated boundary 34, as shown in FIG. 8, to separate pane 32 from cover panel 26 and reveal gift card 102 held within, as shown in FIG. 9.

Referring to FIGS. 12-17, there is shown an example of a greeting card 110 with gift card carrier 10 incorporated therein. Greeting card 110 may be a standard greeting card with dimensions of 5×7 inches, 6.25×4.50 inches, or 8.5×5.5 inches. In a manner similar as that described above, greeting card 110 also includes a base panel 112, a retaining member 114, and a metal shield 116.

Base panel 112 includes a front surface 118 and a back surface 120. Front surface 118 has a holding area 122 that is sized and dimensioned to receive an entire gift card therein.

Retaining member 114 is secured to front surface 118 for releasably securing gift card 102 in holding area 122. In the depicted embodiment, retaining member 114 is a cover panel 126 that is secured to base panel 112. Cover panel 126 and base panel 112, thus, collectively form a double panel with a slot therebetween. The slot is positioned to cover holding area 122 and the slot is dimensioned to receive and hold the entire gift card therein. Unlike the embodiment above, cover panel 126 and base panel 112 themselves also form one of the panels of greeting card 110.

Cover panel 126 further includes a front face 128, a back face 130, and a removable pane 132, where pane 132 is dimensioned and sized to correspond with the slot. As depicted, pane 132 is generally rectangular with rounded corners to correspond with the standard size and shape of gift cards and prepaid cards. Pane 132 is frangibly attached to the rest of cover panel 126 with a perforated boundary 134 along three of its edges. A fourth edge 136 is not attached to the rest of cover panel 126 and helps to define an opening 138 that provides access to the slot. Fourth edge 136 further includes a tab 140.

Metal shield 116 is made of metal. As depicted, metal shield comprises two layers of aluminum 142. One layer is secured to front surface 118 of base panel 112, and the other layer is secured to back face 130 of cover panel 126. Metal shield 116 is at least sized to cover, and positioned to correspond with, holding area 122. In that manner, metal shield 116 covers holding area 122.

Figure 16:
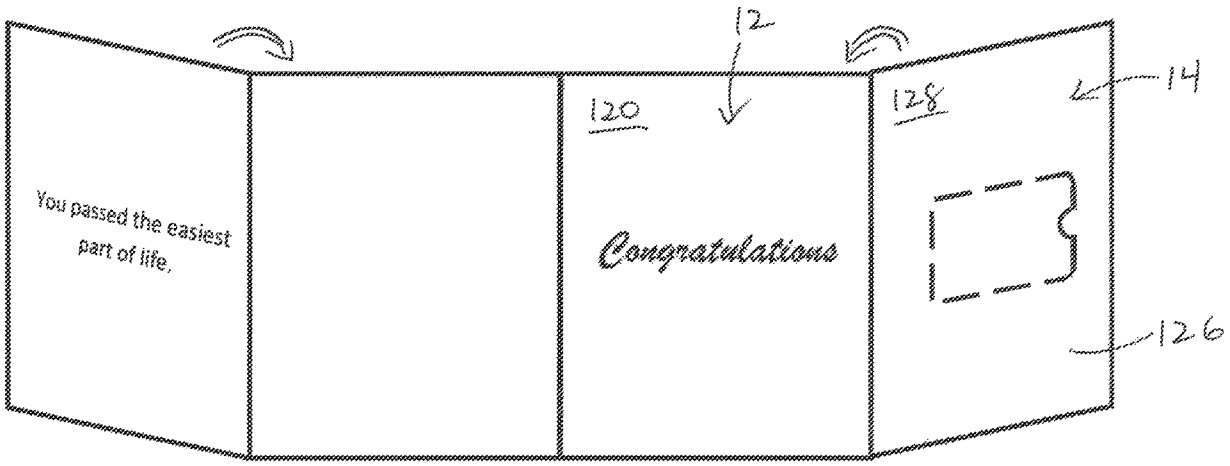
FIG. 16 is a front view of the greeting card of FIG. 12 in an unfolded configuration.
Figure 17:
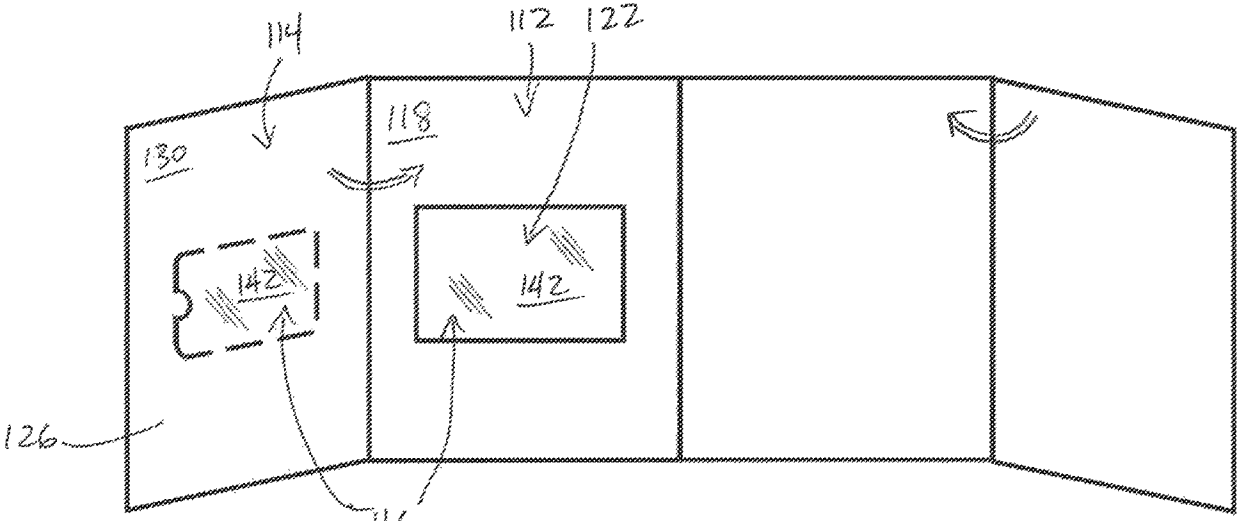
FIG. 17 is a back view of the greeting card of FIG. 16.

FIGS. 12-15 show greeting card 110 in a folded configuration. FIGS. 16-17 show greeting card 110 in an unfolded configuration. In that manner, base panel 112 and cover panel 126 are integrally connected and are formed from a single sheet of material with the other panels of the greeting card. Folding cover panel 126 over base panel 112, and folding the other panel as indicated by the double arrows, forms the double panel of greeting card 110 as shown in FIGS. 12-15.

Figure 14:
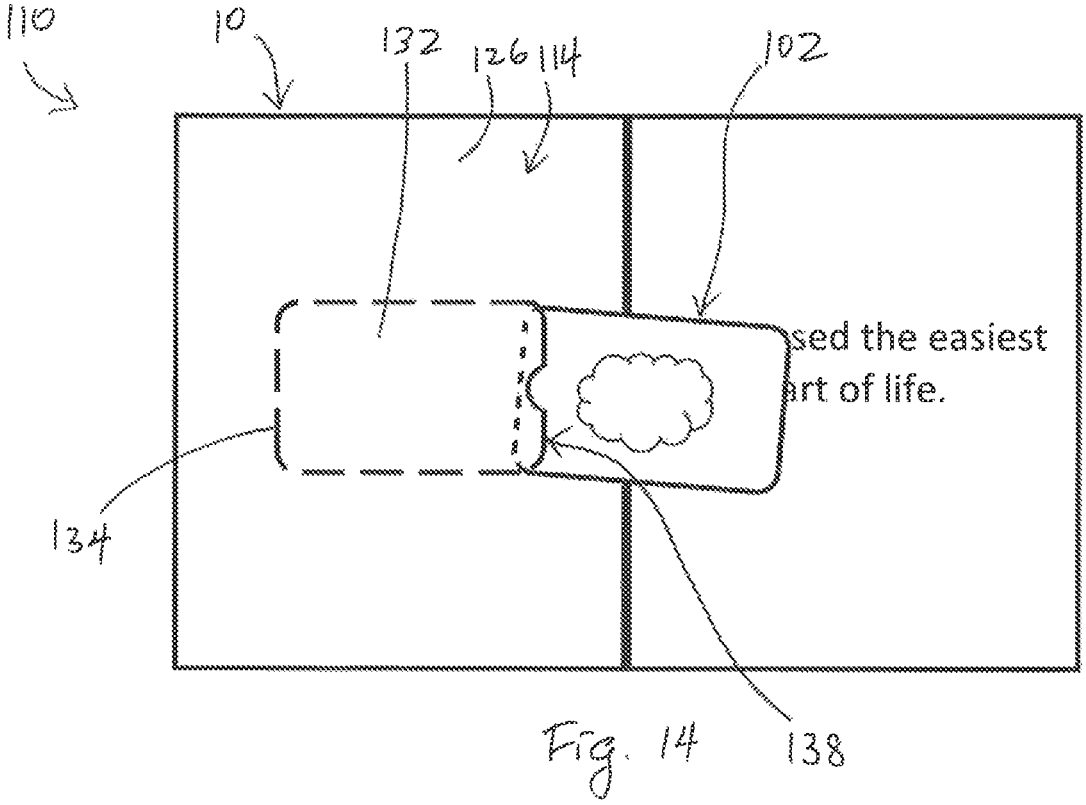
FIG. 14 is an internal view of the greeting card of FIG. 12 with a gift card partially interested into the gift card carrier.

In use, as before, gift card 102 may be inserted into the slot in greeting card 110. Tab 140 may be gripped by a user to assist him or her in separating pane 132 from base panel 112 for access to opening 138. In that manner, gift card 102 may be inserted through opening 138 in the slot between base panel 112 and cover panel 126 as shown in FIG. 14.

Figure 15:
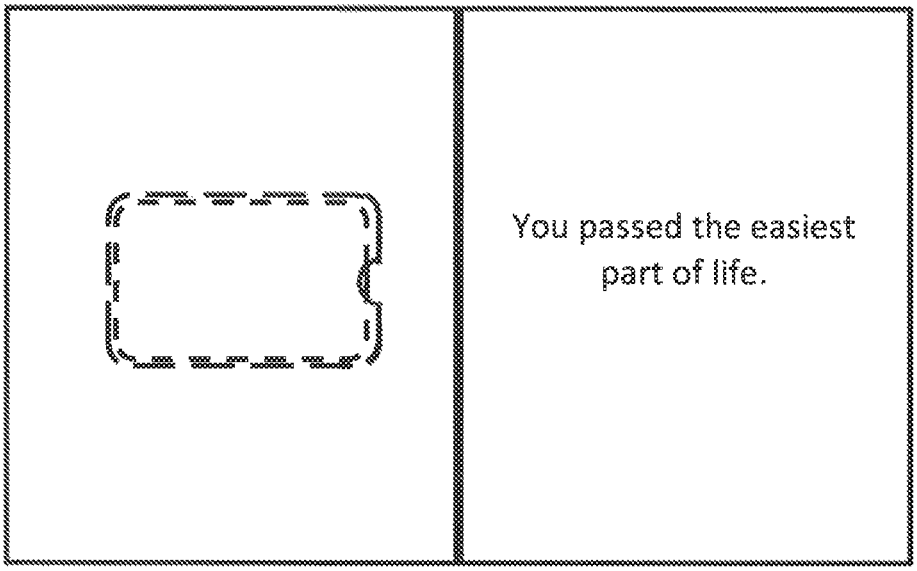
FIG. 15 is an internal view of the greeting card of FIG. 12 with the gift card fully interested into the gift card carrier.

Due to the fact that holding area 122 and the slot are shaped and dimensioned to hold the entire gift card 102 therein with a close fit, gift card 102 may be fully inserted into holding area 122 and the slot through opening 138 as shown in FIG. 15.

To subsequently access gift card 102, a user may grip fourth edge 136, such as at tab 140, and tear pane 132 along perforated boundary 134 to separate pane 132 from cover panel 126 and reveal gift card 102 held within.

While two embodiments of a gift card carrier are described, variations are possible. For example, holding area 22, 122 may be recessed into base panel 12, 112.

While retaining member 14, 114 is shown to be cover panel 26, 126, gift card 102 may be retained in holding area 22, 122 by a different means, such as an adhesive, or corner cuts/folds.

Aluminum layers 42, 142 may instead, or additionally, be secured to back surface 20, 120 of base panel 12, 112, and may instead, or additionally, be secured to front face 28, 128 of cover panel 26, 126. In other embodiments, rather than two layers of aluminum, metal shield 16, 116 may only have one metal layer, positioned either on base panel 12, 112 or cover panel 26, 126.

As well, rather than aluminum layers 42, 142, metal shields 12, 112 may be made from a different metal that can block external scans, such as a nickel alloy or copper.

While removable pane 32, 132 is shown to be dimensioned and sized to cover the entire slot or holding area 22, 122, removable pane 32, 132 may instead be dimensioned and sized to cover a portion of the slot or slot or holding area 22, 122. In this manner, the portion of the slot or slot or holding area 22, 122 covered by the partial removable pane would be dimensioned and sized so its removal would reveal a sufficient section of gift card 102 so to allow access and removal of gift card 102 from gift card carrier 10 or greeting card 110.

While base panel 12, 112 and cover panel 26, 126 are shown to be formed from a single sheet of material, base panel 12, 112 or cover panel 26, 126 may instead be separate sheets of material.

It should be apparent to persons skilled in the arts that various modifications and adaptation of the structures described above are possible without departure from the spirit of the invention the scope of which defined in the appended claims.

The above described gift card carrier 10 and greeting card 110 may have a number of advantages.

For example, if retaining member 14 is cover panel 26, 126, the close fit of gift card 102 within the slot helps to hold gift card 102 in place relative to greeting card 100 or 110, so there is little to no relative movement between them when they are both placed in an envelope. In this manner, a person holding the envelope would not be able to tell that a gift card was inside from shaking the envelope. Once in place, it would be difficult to remove gift card 102 from the slot without tearing the pane. Perforated boundary 34, 134, thus, may also serve as a tamper-evident mechanism to reveal unauthorized access to gift card 102.

If retaining member 14, 114 is an adhesive or corner cuts/folds, gift card 102 may still be releasably held in place relative to greeting card 100 or 110, to prevent relative movement between them when they are placed in an envelope.

Held in this manner, gift card 102 is also abutting or pressed up against aluminum layers 42, 142. Another potential advantage is that the presence of metal shield 16, 116/aluminum layers 42, 142 help to prevent potential external scanning, such as RFID scanning, of gift card 102 from outsiders who may want to steal the value of the gift card held within. Such features may individually or collectively help to enhance the security of sending or transferring gift cards.

What is claimed is:

1. A card for carrying a gift card, the card comprising:
a base panel having a holding area that is sized and dimensioned to receive the gift card;
a cover panel secured to the base panel, the cover panel and the base panel collectively forming a double panel with a slot therebetween, the slot being positioned to cover the holding area and dimensioned to receive and hold the entire gift card therein;
an other panel hingedly connected to the double panel, the other panel having an operative position abutting the double panel and being shaped and dimensioned, when in the operative position, to cover at least the slot; and
a shield adapted to block external scans and secured to one of the base panel, cover panel and other panel, the shield covering the slot at least when the other panel is in the operative position.

2. The card of claim 1 wherein the cover panel includes a perforation defining a frangible pane sized and dimensioned to correspond with the slot.

3. The card of claim 2, wherein the shield is metal.

4. The card of claim 2, wherein the shield is made of one or more of aluminum, nickel and copper.

5. The card of claim 2, wherein the base panel and the cover panel are integrally connected and formed from a single sheet of material, the cover panel folding over the base panel to form the double panel.

6. The card of claim 2, wherein the other panel, the base panel and the cover panel are integrally connected and formed from a single sheet of material, the cover panel folding over the base panel to form the double panel.

7. The card of claim 1, wherein the base panel and the cover panel are integrally connected and formed from a single sheet of material, the cover panel folding over the base panel to form the double panel.

8. The card of claim 1, wherein the other panel, the base panel and the cover panel are integrally connected and formed from a single sheet of material, the cover panel folding over the base panel to form the double panel.

* * * * *